US008177655B2

(12) United States Patent
Hanley

(10) Patent No.: US 8,177,655 B2
(45) Date of Patent: May 15, 2012

(54) PUTTING STROKE TEACHER

(76) Inventor: Kenneth Hanley, Thunder Bay (CA)

( * ) Notice: Subject to any disclaimer, the term of this patent is extended or adjusted under 35 U.S.C. 154(b) by 0 days.

(21) Appl. No.: 12/909,951

(22) Filed: Oct. 22, 2010

(65) Prior Publication Data

US 2012/0015755 A1 Jan. 19, 2012

Related U.S. Application Data

(60) Provisional application No. 61/334,224, filed on May 13, 2010.

(51) Int. Cl.
*A63B 69/36* (2006.01)

(52) U.S. Cl. ..... 473/226; 473/227; 473/276

(58) Field of Classification Search ..... 473/201, 473/206, 207, 212, 219, 223, 226, 227, 266, 473/276, 422
See application file for complete search history.

(56) References Cited

U.S. PATENT DOCUMENTS 1,684,192 A * 9/1928 Nemeth ..... 473/227
5,156,401 A * 10/1992 Hodgkiss ..... 473/227
5,248,146 A 9/1993 Viets et al.
5,470,073 A 11/1995 Vasquez
5,851,156 A * 12/1998 Schwark, Jr. ..... 473/201
5,904,624 A * 5/1999 Martinez ..... 473/212
5,976,024 A 11/1999 Marshall
6,004,221 A 12/1999 Thornhill
6,939,243 B1 9/2005 Mitchell et al.

* cited by examiner

*Primary Examiner* — Nini Legesse
(74) *Attorney, Agent, or Firm* — Daniel Boudwin; Alexander Boyer

(57) ABSTRACT

A T-shaped golf instructional tool adapted to fit over the grip end of a conventional or belly-type putter for the purpose of teaching a proper putting stroke and improving consistency. An attach bar is fixed to a putter grip using hook and loop fastened straps. The attach bar extends above the putter between the user's forearms, where two horizontal rods are fixed to the attach bar at a common junction. The horizontal rods provide feedback to the user and ensure his or her forearms, wrists and arms stay positioned together through the putting stroke. The horizontal rods align perpendicular to the putter face, allowing alignment of the shoulders and feet relative to the intended target. The attach bar can be adjusted out of plane relative to the putter swing path to accommodate different user geometry and proper posture over the ball.

4 Claims, 3 Drawing Sheets

PUTTING STROKE TEACHER

CROSS REFERENCE TO RELATED APPLICATION

This application claims the benefit of U.S. Provisional Application No. 61/334,224 filed on May 13, 2010, entitled "The Putting Stroke Teacher"

BACKGROUND OF THE INVENTION

1. Field of the Invention

The present invention relates to golf instructional aides, specifically putting implements for teaching proper putting technique.

2. Description of the Prior Art

Putting is an essential part of the game of golf, as it is required on nearly every hole and accounts for at least 1 to 2 strokes. The act of putting involves hitting the golf ball into the hole from distances inside and around the putting green. Proper putting stroke mechanics are essential for consistency and accuracy. These mechanics include body alignment relative to the ball and the intended target, proper hand, wrist and forearm position relative to the putter, and a consistent stroke that mimics a pendulum motion where the putter head is accelerated through the golf ball on the down stroke. If properly practiced, these mechanics can be mastered to improve a golfer's putting prowess and consistency on the putting green.

The putting stroke determines the direction and speed of the ball as it traverses the green, and ultimately the accuracy of the putt. It is therefore considered extremely important for a golfer to develop the correct putting fundamentals. Several putting training aides have been suggested that include hand and wrist positioning devices and putter extensions to maintain a fluid stroke while preventing wrist rotation relative to the forearms. Commonly known as "breaking" of the wrists, this rotation often leads to putt inaccuracy as the face of the putter is not controlled through the putting stroke.

One such training aide is disclosed by Vasquez, U.S. Pat. No. 5,470,073. This device uses a linkage that extends from the end of a conventional putter and traverses outward to engage the inner portion of the golfer's forearms. Pads at the end of the linkage constrain the forearms together in an unalterable position as to create a unified geometry through the putting stroke. This device constrains the golfer to the point where the device does not allow natural motion and feedback to the golfer through the stroke, as would occur without the linkages. The constrained motion does not allow the golfer to develop the correct stroke independent of the linkages, creating a crutch. Additional practice is necessary to gain the feel of the stroke without these forearm constraints.

A device with a similar drawback as that seen in Vasquez is described in U.S. Pat. No. 5,248,146 to Viets, et al. in which the wrists and inner forearms are engaged by channels that constrain the golfer and remove unwanted wrist rotation through the putting stroke. The channels are held in position and joined together by a rigid attach bar that extends between the forearms and attaches the device to the end of the putter handle. Along with the previously stated constraint disadvantage, the user's grip on the putter required to attach this device to the end of the putter handle involves choking up on the putter or increasing the angle of the forearms to accommodate the attachment pin. This changes the golfer's posture or requires an unnatural forearm angle to grip the club.

U.S. Pat. No. 5,976,024 to Marshall describes a golf club attachment device which helps the golfer achieve the correct club face rotation at the top of a full golf swing. The device extends from the grip of the club and contacts either forearm during the backswing as the wrist rotates at the top of a swing. This device does not assist the golfer during the address position, as the golfer sets up his body position and initial grip of the club prior to swinging. It also does not provide any assistance while practicing putting, which requires a stable wrist and forearm configuration that does not change during the backswing or follow through.

U.S. Pat. No. 5,904,624 to Martinez is a similar training device as that of Vasquez, which discloses a collapsible and height adjustable putting stroke trainer. This device also places constraints on the user's forearms in an attempt to maintain their position through the putting stroke.

U.S. Pat. No. 6,004,221 to Thornhill discloses a putting training device that extends a forward and rearward arm from a putter grip to create contact points on the outer side of the forearms. This device provides very little feedback for rotation about the club axis (i.e. rotation of the club face during the swing) as well as outward motion of the club in a direction perpendicular to the intended shot line. Both of these rotations cause inaccuracy in the putting stroke, as the putter face strikes the ball with an inward-outward motion or at an angle relative to the target line.

U.S. Pat. No. 6,939,243 to Mitchell, et al. discloses another putting training attachment for a golf putter, in which a singular or two pronged flange extends from the putter handle to the user's forearms with the intention of creating a stabilized wrist-forearm arrangement through the putting stroke. While this device does not attach to the forearm and overly constrain the wrist and forearm, it lacks the ability to prevent rigid body rotation of the wrist-forearm arrangement as the club is being swung. It also lacks the ability to teach proper alignment during putt setup.

Several putter lengths are described in the art, including conventional, belly and long putters. Conventional putters are the most common type, with handles that terminate around waist level and require the most wrist control though the putting stroke. Belly putters extend higher than a conventional putter to create a third contact point with the abdomen of the user for greater control. Long putters are longer still and emphasize a full-body pendulum motion during the putting stroke. Conventional putters require the most wrist control, while belly putters reduce effort required to control the wrists and long putters completely remove wrist action through the putting stroke.

SUMMARY OF THE INVENTION

In view of the foregoing disadvantages inherent in the known types of putting training devices now present in the prior art, the present invention provides a new putting training device wherein the same can be utilized for providing convenience for the user when practicing his or her putting stroke. The object of the present invention is to provide a lightweight, T-shaped putting stroke training device that attaches to a conventional or belly-type golf putter for teaching proper swing technique and building consistency.

Another object of the present invention is to provide a T-shaped putting stroke training device which is useful for aligning the user to the intended target during the approach to the ball.

Yet another object of the present invention is to provide a T-shaped putting stroke training device which does not constrain the user's arms during the putting stroke, but provides tactile feedback in the way of contact with the horizontal section of the "T" which presses against the tops of the user's forearms if rotation of the wrists occurs.

Other objects, features and advantages of the present invention will become apparent from the following detailed description taken in conjunction with the accompanying drawings.

BRIEF DESCRIPTIONS OF THE DRAWINGS

DETAILED DESCRIPTION OF THE INVENTION

Figure 1:
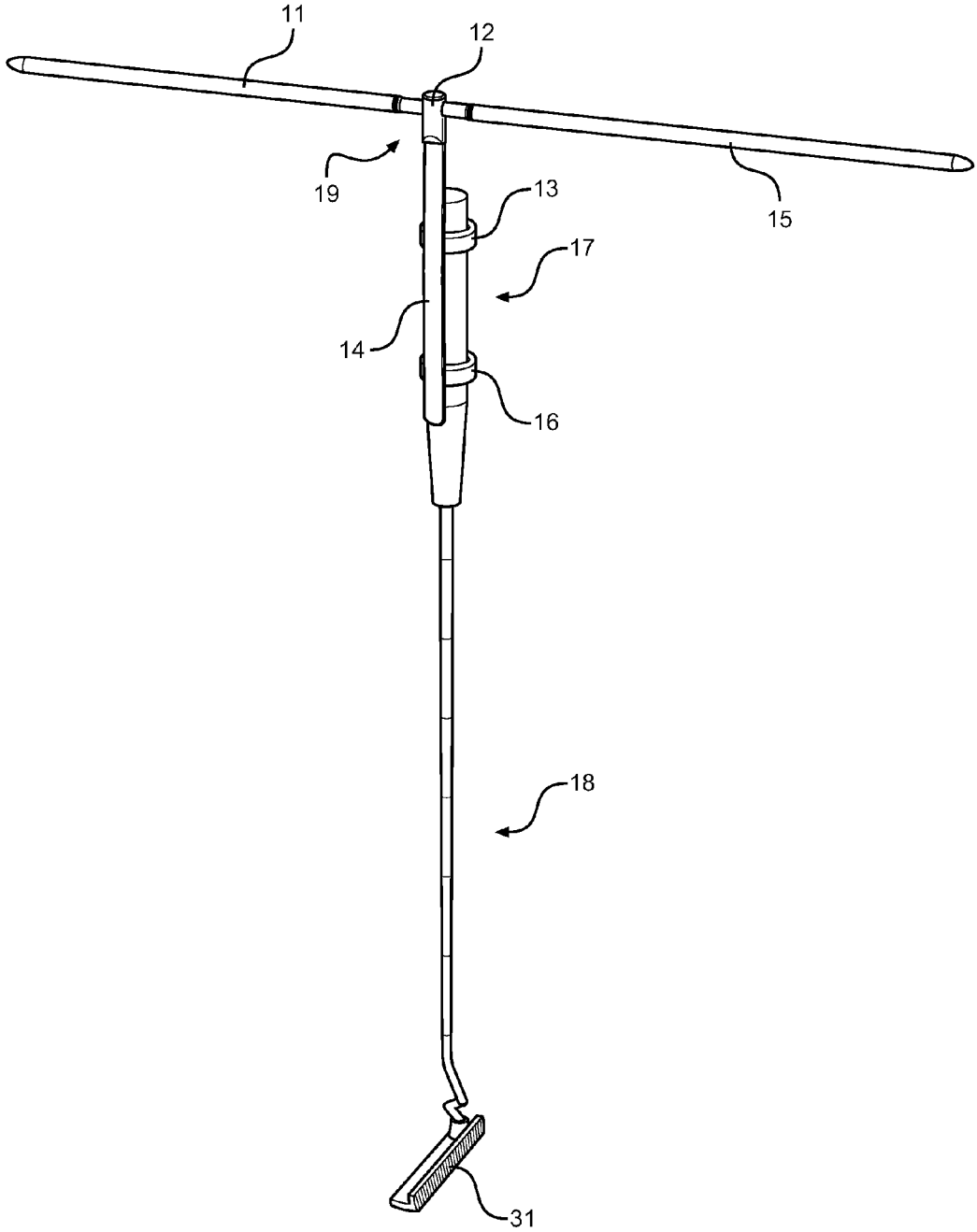
FIG. 1 Shows a perspective view of the putting stroke teacher attached to a conventional style putter.

Referring now to FIG. 1, there is shown a perspective view of the putting stroke teacher 19 attached to the handle 17 of a conventional style putter 18. Two or more hook and loop fastened straps 13,16 secure the attach bar 14 portion of the T-shaped putting stroke teacher 19. The attach bar 14 extends vertically above the putter handle 17, and is capable of being manipulated outward from the user, in a direction parallel to the putter club face 31, to accommodate different user wrist and forearm dimensions and posture over the ball. The attach bar 14 terminates at a junction 12, which connects horizontal rods 11,15 that extend perpendicular to the attach bar 14.

Figure 2:
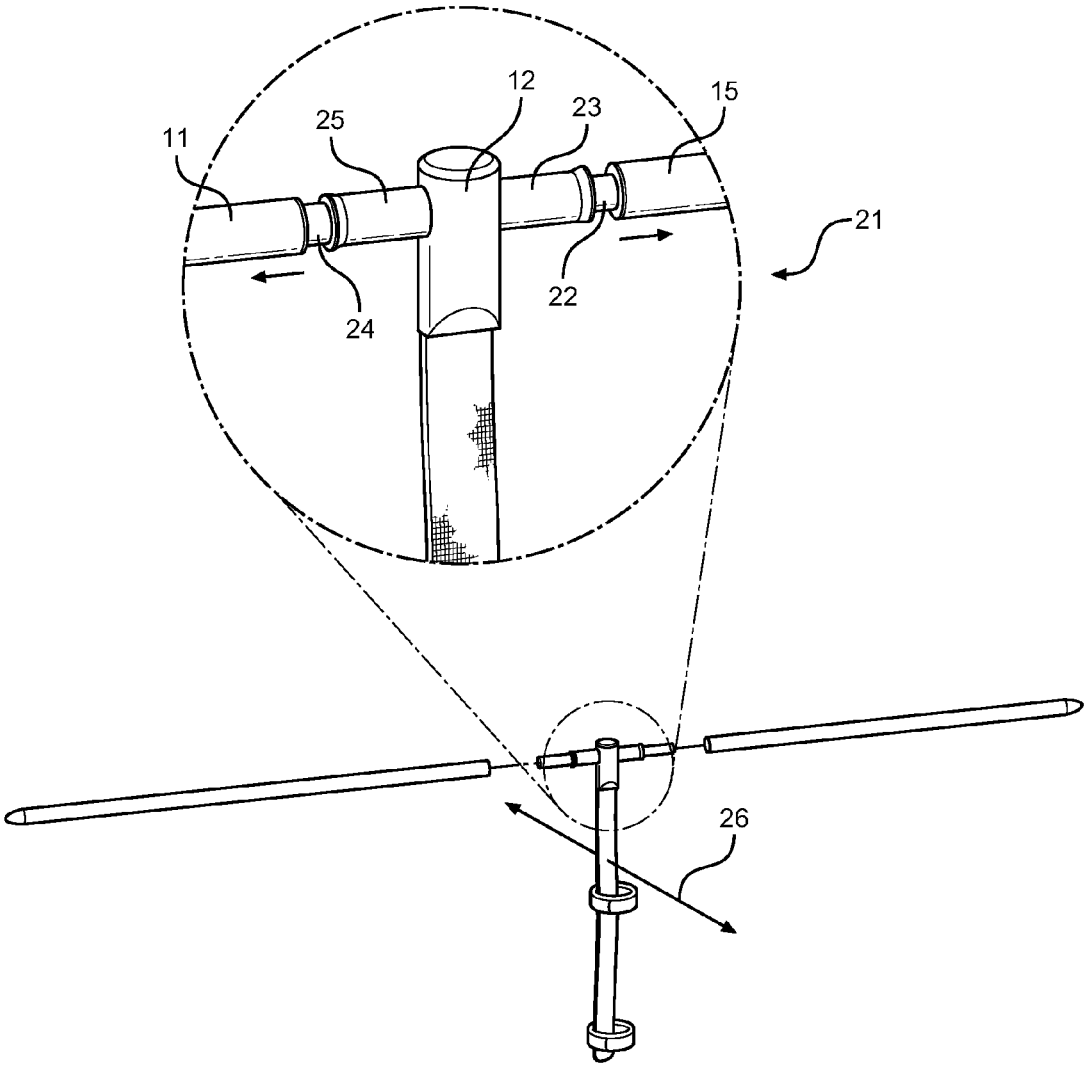
FIG. 2 Shows an exploded view of the putting stroke teacher, including a close-up view of the horizontal rods' attachment to the putter attachment bar.

Referring now to FIG. 2, there is shown a close-up view 21 of the connection between the attach bar 14 and the horizontal rods 11,15. The junction 12 is attached to the attach bar 14, and includes two shanks 23,25 which extend perpendicular to and symmetric about the attach bar 14. The shanks 23,25 can be configured as a female threaded attachment which accommodate the male threaded screw portion 22,24 of the horizontal rods 15,11, or a male threaded portion 22,24 that may be incorporated on the shanks 23,25 and the horizontal rods 15,11 attach using female threads. The attach bar 14 can be adjusted out-of-plane, along a vector 26 normal to the attach bar 14 flat surface to accommodate the user's grip on the handle 17.

Figure 3:
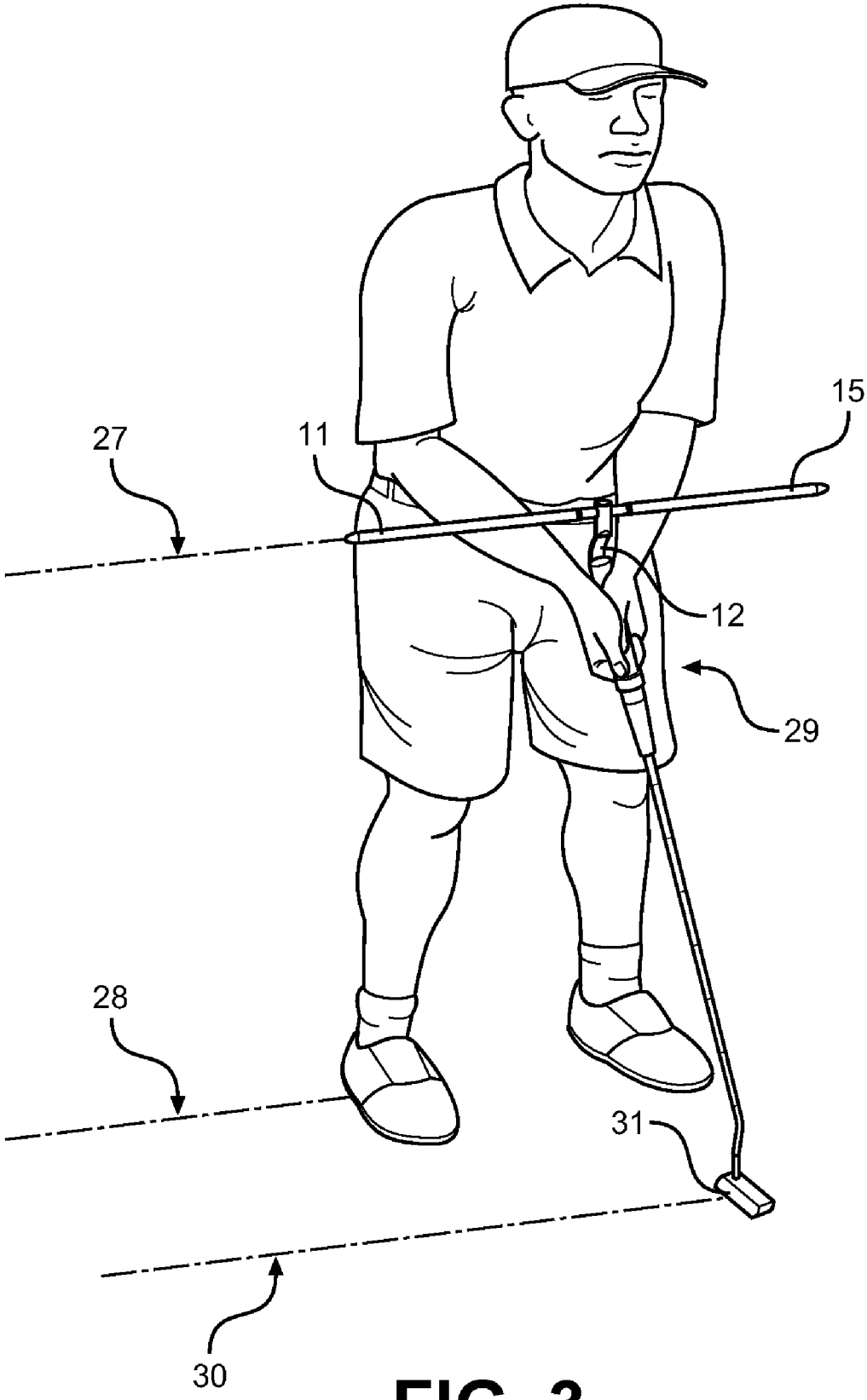
FIG. 3 Shows the putter stroke teacher in use, including the intended position of the golfer's hands, forearms and shoulder relative to the T-section.

Referring now to FIG. 3, there is shown the putter stroke teacher in use. Horizontal rods 11,15 lie on the tops of the user's forearms and provide tactile feedback through the stroke. The user's grip 29 is not constrained by the horizontal rods 11,15. The attach bar 14 is adjustable to accommodate the user's grip 29 and allow proper posture over the ball. A tangent line 27 from of the horizontal rods 11,15 is used as a guide for the user's feet alignment 28 and the intended target line 30 for the ball and putter face 31. The intended target line 30 is a normal vector projected from the putter club face 31. These three lines teach proper setup over the ball and alignment with the intended target. While attaching the putting stroke teacher 19 to the handle 17 of the putter 18, the horizontal rods 11,15 are intended to be aligned parallel to the intended target line 30 projecting from the putter club face 31.

In use an individual would attach the putting stroke teacher to the handle of a conventional or belly-type putter, take a putting grip on the handle and use the feedback from the horizontal rods as an indicator of whether the wrists are breaking position through the stroke. The attach bar can be adjusted to the user's liking by bending the bar away from the handle of the putter to allow proper grip and posture over the ball. The horizontal rods form a tangent line parallel to the target line. The rods are therefore useful for aligning the position of the user's feet at the intended target and for indicating the true path of the ball upon initial contact. Feedback from the horizontal rods will come in the form of 1) non-uniform pressure on both forearms, indicating wrist rotation, 2) uniform contact pressure and separation, indicating an inward-outward path of the putter face, and 3) sliding friction on the forearms, which indicates wrist bending through the putting stroke. The horizontal rods are capable of being attached and removed from the junction as necessary by the user for transportation and storage.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An instructional aide attachable to a conventional or belly-type putter for use in practicing a putting stroke and aligning an individual with an intended path of a golf ball towards a target, comprising;

a vertical attach bar adapted to be secured to a handle of a putter, said vertical attach bar having an upper and lower end, wherein said upper end is joined to a junction that provides connection for two opposing horizontal rods; said horizontal rods form a tangent line parallel to a normal vector projected from said putter club face, and extending laterally across upper surfaces of a user's forearms for tactile feedback without restraining lateral motion of a user's arms through a putting stroke motion.

2. The apparatus of claim 1, wherein said upper end of said attach bar is adjustable out of plane relative to a putter swing path by means of bending said attach bar structure to properly align said horizontal rods onto a user's forearms while in a putting stance.

3. The apparatus of claim 1, wherein said horizontal rod connection comprises a removable, threaded joint that allows said rods to be removed from said junction.

4. An instructional aide attachable to a conventional or belly-type putter for use in practicing a putting stroke and aligning an individual with an intended path of a golf ball towards a target, comprising;

a vertical attach bar adapted to be secured to a handle of a putter, said attach bar having an upper and lower end, wherein said upper end is adjustable out of plane relative to a putter swing path by means of bending said attach bar structure to properly align said horizontal rods onto a user's forearms while in a putting stance; said upper end is joined to a junction which provides connection for two opposing horizontal rods; said horizontal rods form a tangent line parallel to a normal vector projected from said putter club face, and extending laterally across upper surfaces of a user's forearms for tactile feedback through a putting stroke motion.

* * * * *